US010468771B2

(12) United States Patent
Mentesana et al.

(10) Patent No.: US 10,468,771 B2
(45) Date of Patent: Nov. 5, 2019

(54) SURFACE CARD ANTENNA APPARATUS

(71) Applicant: The Boeing Company, Chicago, IL (US)

(72) Inventors: Nicholas B. Mentesana, Saint Louis, MO (US); Matthew G. Rivett, Seattle, WA (US)

(73) Assignee: The Boeing Company, Chicago, IL (US)

( * ) Notice: Subject to any disclaimer, the term of this patent is extended or adjusted under 35 U.S.C. 154(b) by 294 days.

(21) Appl. No.: 14/883,733

(22) Filed: Oct. 15, 2015

(65) Prior Publication Data

US 2017/0110797 A1 Apr. 20, 2017

(51) Int. Cl.

| | |
|---|---|
| ***H01Q 13/10*** | (2006.01) |
| ***H01Q 9/04*** | (2006.01) |
| ***H01Q 1/28*** | (2006.01) |
| ***H01Q 21/06*** | (2006.01) |
| ***H01Q 21/24*** | (2006.01) |
| ***H01Q 1/38*** | (2006.01) |

(52) U.S. Cl.

CPC ..... *H01Q 9/04* (2013.01); *H01Q 1/286* (2013.01); *H01Q 1/38* (2013.01); *H01Q 21/064* (2013.01); *H01Q 21/24* (2013.01)

(58) Field of Classification Search

CPC ..... H01Q 9/04; H01Q 1/38; H01Q 21/0043; H01Q 21/005; H01Q 1/0056; H01Q 21/064; H01Q 1/286; H01Q 21/24

See application file for complete search history.

(56) References Cited

U.S. PATENT DOCUMENTS

| | | | | |
|---|---|---|---|---|
| 4,742,354 | A * | 5/1988 | Wen | G01S 7/026 333/116 |
| 6,031,503 | A * | 2/2000 | Preiss, II | G06K 19/07743 343/770 |
| 7,075,494 | B2 * | 7/2006 | Sergey | H01Q 3/22 343/700 MS |
| 8,378,921 | B2 | 2/2013 | Delfeld et al. | |
| 2002/0118143 | A1 * | 8/2002 | Yokoshima | H01Q 1/22 343/895 |
| 2003/0210195 | A1 | 11/2003 | Hager et al. | |
| 2004/0001023 | A1 * | 1/2004 | Peng | H01Q 1/38 343/725 |

(Continued)

FOREIGN PATENT DOCUMENTS

| | | |
|---|---|---|
| FR | 2 903 195 | 1/2008 |
| WO | 03/090314 | 10/2003 |

OTHER PUBLICATIONS

European Patent Office, Extended European Search Report, EP 16 18 6669 (Mar. 15, 2017).

(Continued)

*Primary Examiner* — Dieu Hien T Duong

(74) *Attorney, Agent, or Firm* — Walters & Wasylyna LLC

(57) ABSTRACT

A surface card antenna apparatus comprises a single circuit board having a major side surface. The surface card antenna apparatus further comprises a horizontal polarization antenna portion mounted on the major side surface of the single circuit board. The surface card antenna apparatus also comprises a vertical polarization antenna portion mounted on the major side surface of the single circuit board.

23 Claims, 14 Drawing Sheets

(56) References Cited

U.S. PATENT DOCUMENTS

| | | | | |
|---|---|---|---|---|
| 2004/0090366 | A1* | 5/2004 | Wong | H01Q 1/243<br>343/700 MS |
| 2008/0143602 | A1* | 6/2008 | Mak | H01Q 3/24<br>342/374 |

OTHER PUBLICATIONS

European Patent Office, "Communication pursuant to Article 94(3) EPC," App. No. 16 186 669.4 (dated Aug. 28, 2019).

* cited by examiner

SURFACE CARD ANTENNA APPARATUS

FIELD

The present invention relates to antennas, and is particularly directed to a surface card antenna apparatus.

BACKGROUND

An antenna is a transducer which converts radio frequency (RF) energy to electromagnetic waves, and vice versa. As a transmitter, an antenna converts RF electrical current into electromagnetic waves. As a receiver, an antenna converts electromagnetic waves into RF electrical current. An electromagnetic wave has a polarization which is determined by its electric field plane.

Some antennae are linear polarized in that these antennae radiate (or receive) RF energy wholly in one plane containing the direction of propagation. An antenna is horizontally polarized when its electric field oscillates parallel to the ground surface of the earth. An antenna is vertically polarized when its electric field oscillates perpendicular to the ground surface of the earth.

A surface card antenna is one type of antenna. A surface card antenna is low profile, and can be mounted to a curved surface of a structure, such as a skin panel of an aircraft. It would be desirable to provide a surface card antenna which provides both the functionality of a horizontal polarization antenna and the functionality of a vertical polarization antenna.

SUMMARY

In one aspect, a surface card antenna apparatus comprises a single circuit board having a major side surface, a horizontal polarization antenna portion mounted on the major side surface of the single circuit board, and a vertical polarization antenna portion mounted on the major side surface of the single circuit board.

In another aspect, a surface card antenna apparatus comprises a single circuit board, a horizontal polarization antenna portion mounted on the single circuit board, and a vertical polarization antenna portion mounted on the single circuit board, wherein the vertical polarization antenna portion includes a number of interleaved capacitive layers for tuning gain and tuning cutoff frequency of the vertical polarization antenna portion.

In yet another aspect, a surface card antenna apparatus comprises a single circuit board having a major side surface, wherein the single circuit board comprises a polyimide material. The surface card antenna apparatus also comprises a vertical polarization antenna portion mounted on the major side surface of the single circuit board, wherein (i) the vertical polarization antenna portion is mounted at an opposite end portion of the single circuit board, (ii) the vertical polarization antenna portion includes a number of vertical polarization splitters/combiners mounted in vicinity of the vertical polarization antenna portion, and (iii) the vertical polarization antenna portion includes a vertical radio frequency (RF) connector mounted in vicinity of the vertical polarization antenna portion. The surface card antenna apparatus further comprises a horizontal polarization antenna portion mounted on the major side surface of the single circuit board, wherein (i) the horizontal polarization antenna portion is mounted at one end portion of the single circuit board, (ii) the horizontal polarization antenna portion includes a number of horizontal polarization splitters/combiners mounted in vicinity of the vertical polarization antenna portion, and (iii) the horizontal polarization antenna portion includes a horizontal RF connector mounted in vicinity of the vertical polarization antenna portion. The surface card antenna apparatus further comprises a plurality of feedlines interconnecting the horizontal polarization antenna portion and the vertical polarization antenna portion.

Other aspects will become apparent from the following detailed description, the accompanying drawings and the appended claims.

DETAILED DESCRIPTION

The present invention is directed to a surface card antenna apparatus. The specific construction of the surface card antenna apparatus and the industry in which the surface card antenna apparatus is implemented may vary. It is to be understood that the disclosure below provides a number of embodiments or examples for implementing different features of various embodiments. Specific examples of components and arrangements are described to simplify the present disclosure. These are merely examples and are not intended to be limiting.

By way of example, the disclosure below describes a surface card antenna apparatus implemented by the Boeing Corporation for aircraft in compliance with Federal Aviation Administration (FAA) regulations.

Figure 1:
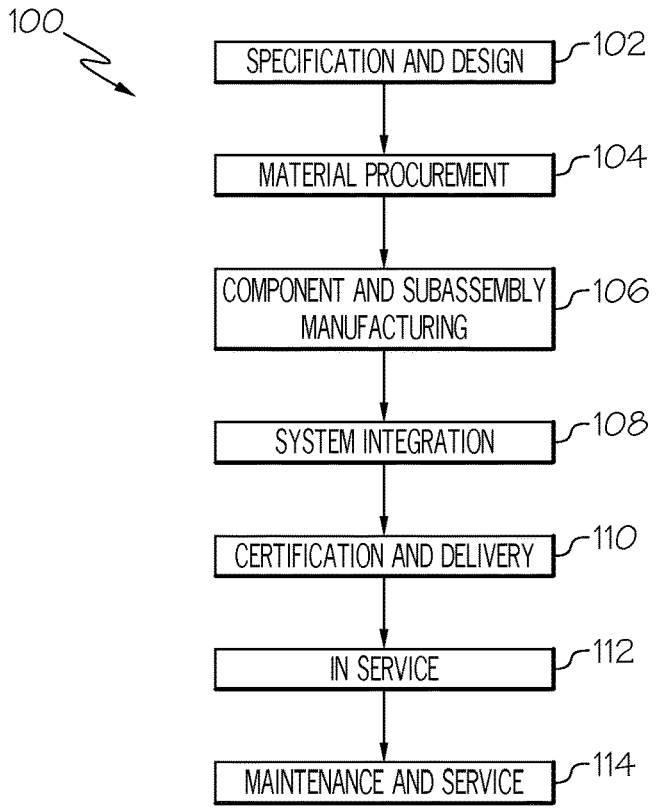
FIG. 1 is a flow diagram of an aircraft manufacturing and service methodology.
Figure 2:
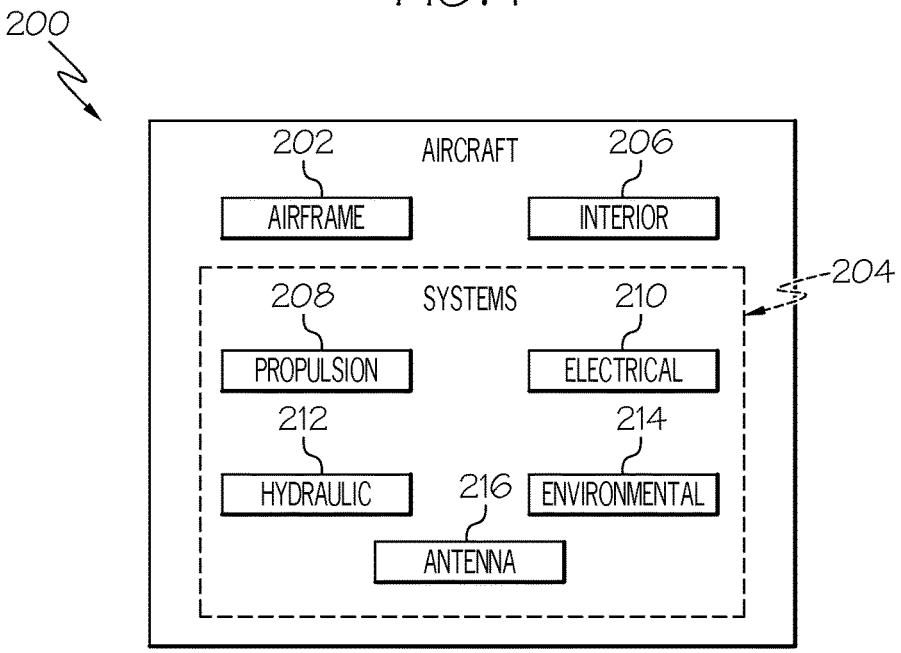
FIG. 2 is a block diagram of an aircraft.

Examples of the present disclosure may be described in the context of an aircraft manufacturing and service method 100 as shown in FIG. 1 and an aircraft 200 as shown in FIG. 2. During pre-production, the illustrative method 100 may include specification and design, as shown at block 102, of the aircraft 200 and material procurement, as shown at block 104. During production, component and subassembly manufacturing, as shown at block 106, and system integration, as shown at block 108, of the aircraft 200 may take place. Thereafter, the aircraft 200 may go through certification and delivery, as shown block 110, to be placed in service, as shown at block 112. While in service, the aircraft 200 may be scheduled for routine maintenance and service, as shown at block 114. Routine maintenance and service may include modification, reconfiguration, refurbishment, etc. of one or more systems of the aircraft 200.

Each of the processes of illustrative method 100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 2, the aircraft 200 produced by illustrative method 100 (FIG. 1) may include an airframe 202 with a plurality of high-level systems 204 and an interior 206. Examples of high-level systems 204 may include one or more of propulsion system 208, electrical system 210, hydraulic system 212, environmental system 214, and antenna system 216. Any number of other systems may be included. Although an aerospace example is shown, the principles disclosed herein may be applied to other industries, such as the automotive and marine industries. Accordingly, in addition to the aircraft 200, the principles disclosed herein may apply to other vehicles (e.g., land vehicles, marine vehicles, space vehicles, etc.).

The disclosed surface card antenna apparatus may be employed during any one or more of the stages of the manufacturing and service method 100. For example, components or subassemblies corresponding to component and subassembly manufacturing (block 106) may be fabricated or manufactured using the disclosed surface card antenna apparatus. Also, the disclosed surface card antenna apparatus may be utilized during production stages (blocks 106 and 108), for example, by substantially expediting assembly of or reducing the cost of aircraft 200, such as the airframe 202 and/or the interior 206. Similarly, the disclosed surface card antenna apparatus may be utilized, for example and without limitation, while aircraft 200 is in service (block 112) and/or during the maintenance and service stage (block 114).

Figure 3:
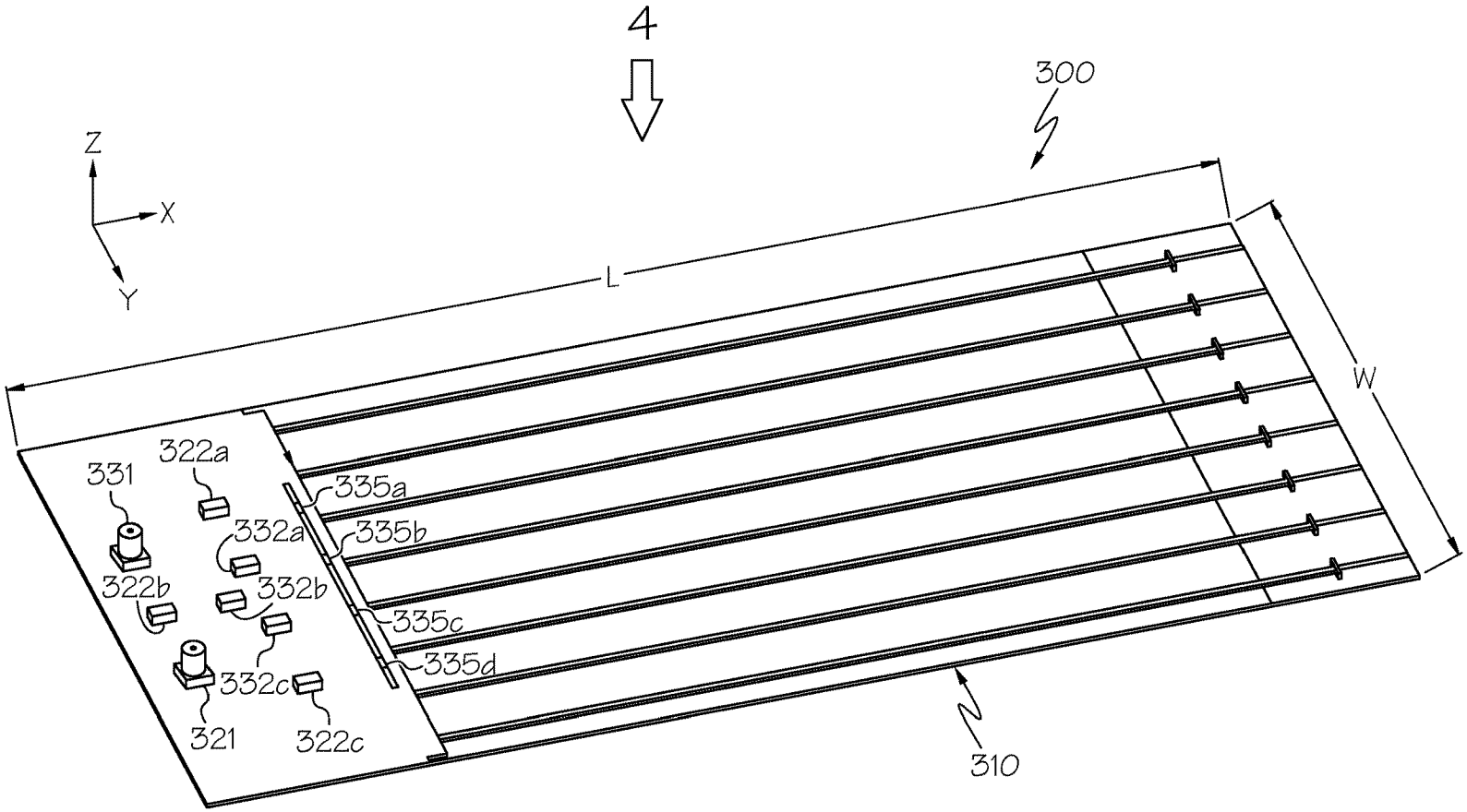
FIG. 3 is a perspective view of a surface card antenna apparatus constructed in accordance with an embodiment.

Referring to the perspective view of FIG. 3, surface card antenna apparatus 300 constructed in accordance with an embodiment is shown. Surface card antenna apparatus 300 is suitable for mounting to a skin panel of an aircraft, for example. Surface card antenna apparatus 100 may be mounted to aircraft skin panels according to FAA regulations. Specifications of FAA regulations for mounting antenna to aircraft skin panels are known and, therefore, will not be described. Surface card antenna apparatus 300 has single circuit board 310 having dimensions of about "L" in length and about "W" in width.

Figure 4:
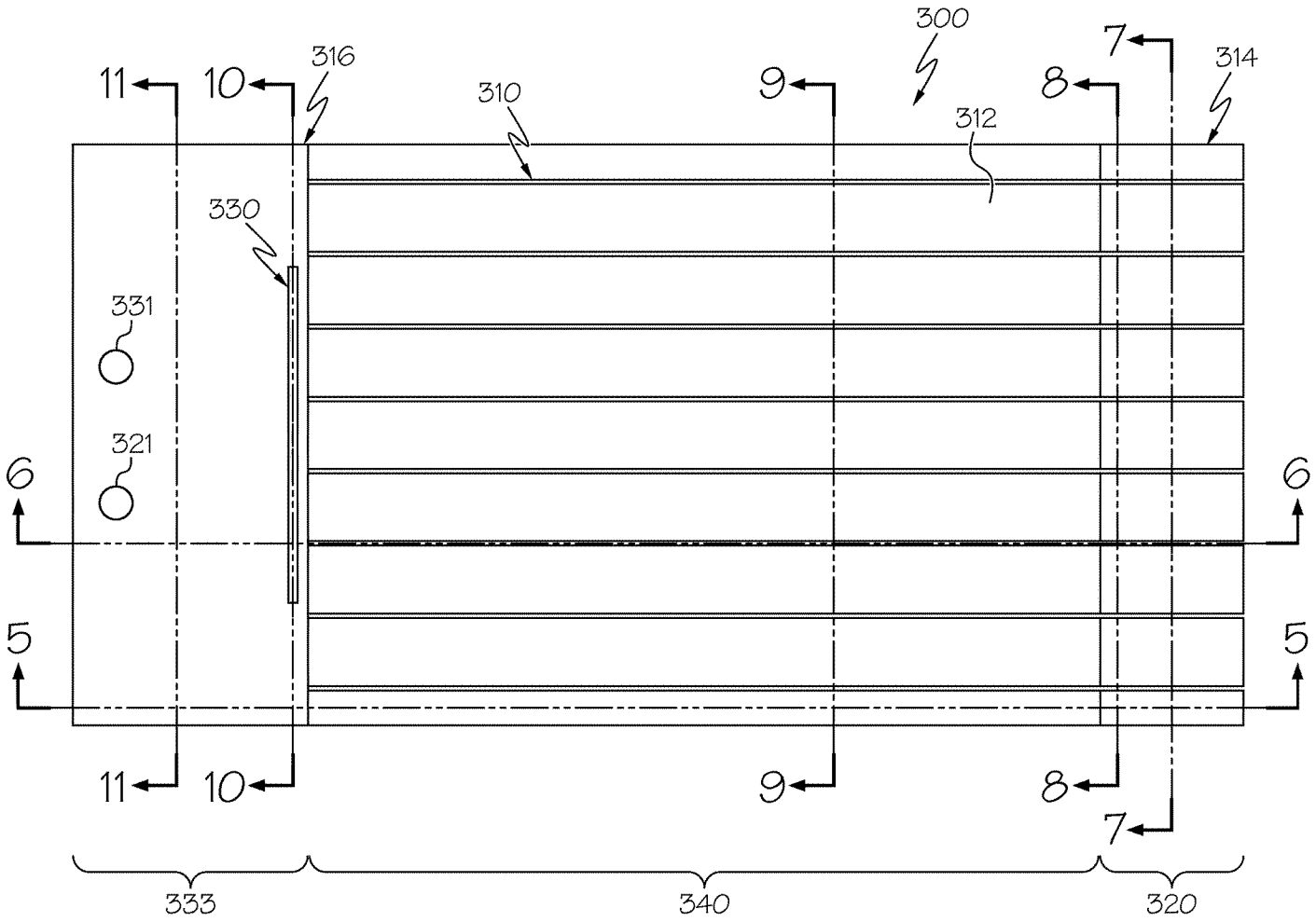
FIG. 4 is a top view, looking approximately in the direction of arrow "4" shown in FIG. 3, of the surface card antenna apparatus.
Figure 5:
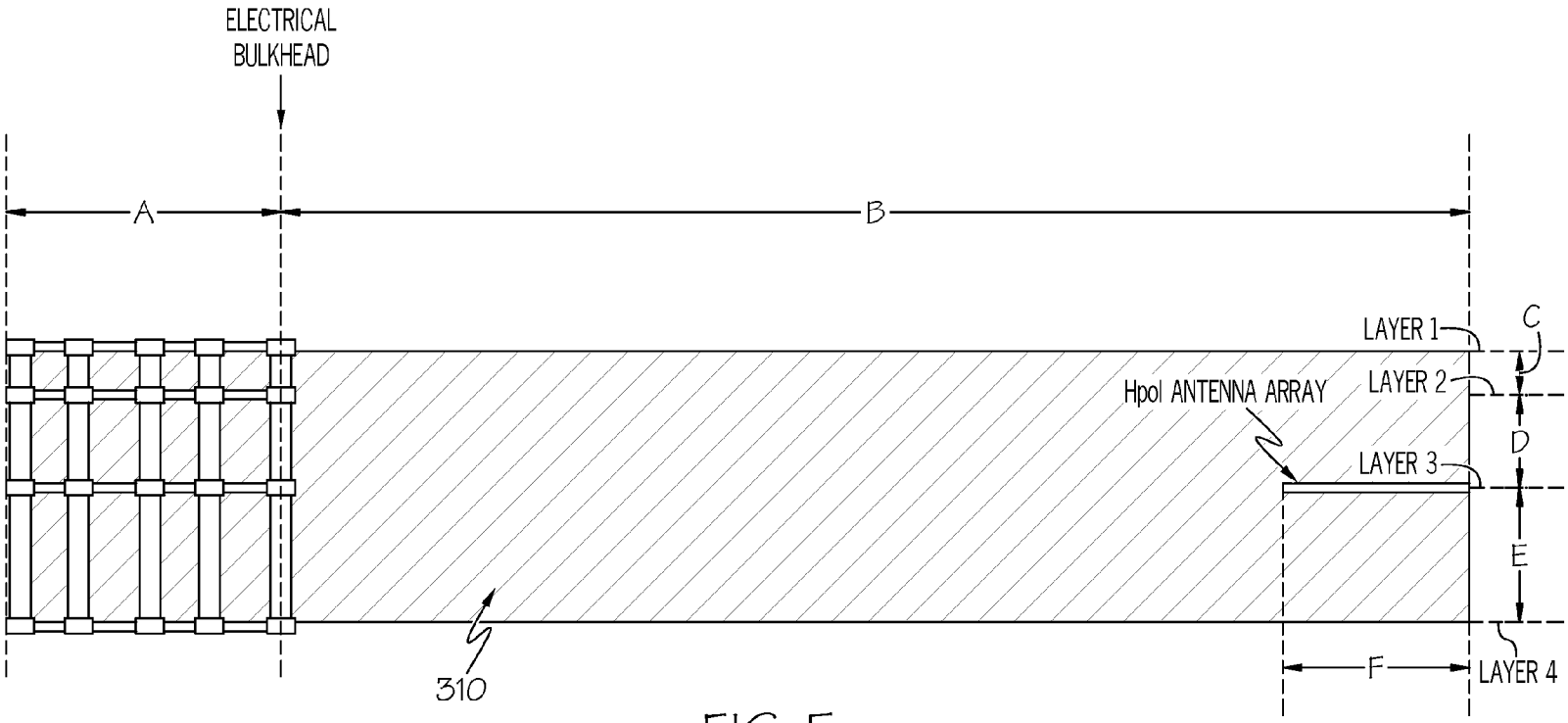
FIG. 5 is a cross-sectional view, taken approximately along line 5-5 shown in FIG. 4, of the surface card antenna apparatus.
Figure 6:
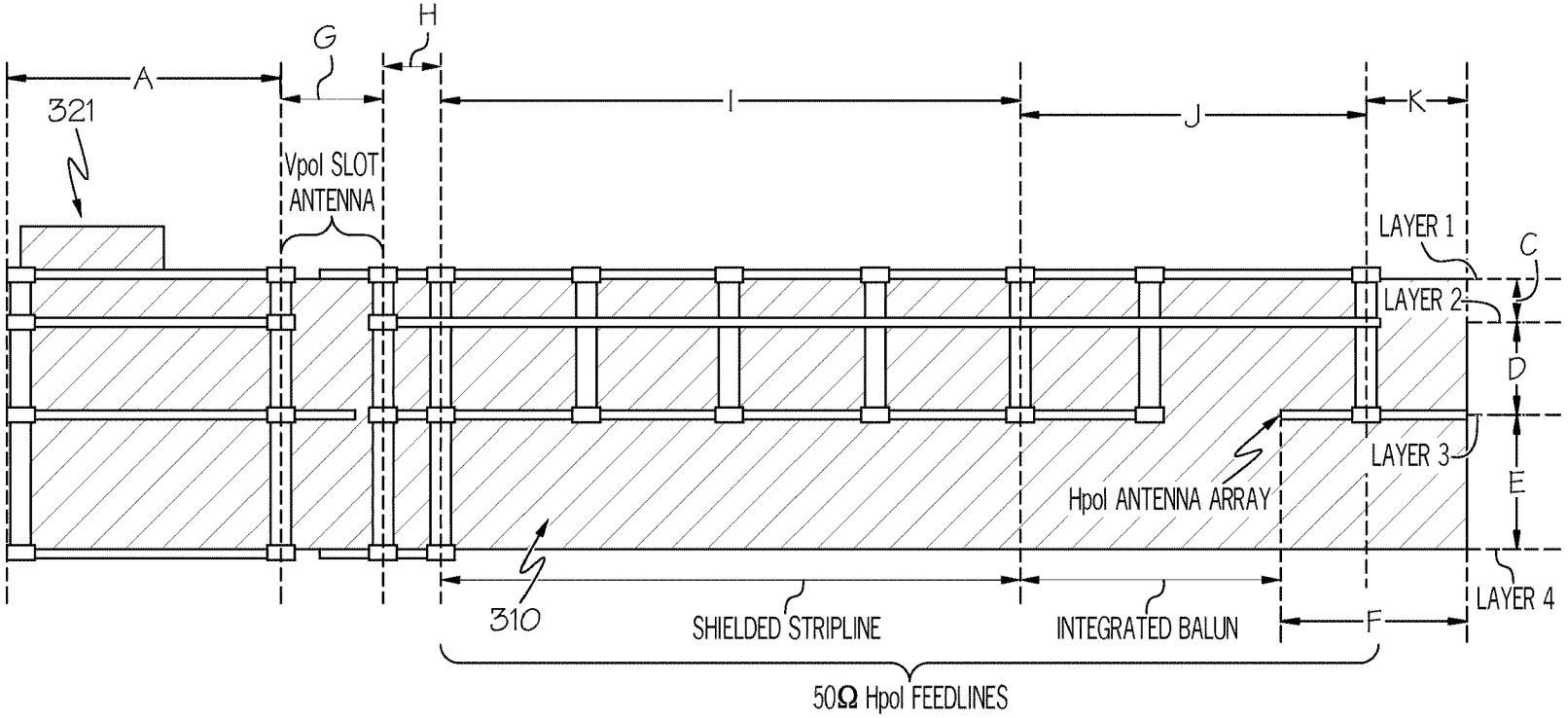
FIG. 6 is a cross-sectional view, taken approximately along line 6-6 shown in FIG. 4, of the surface card antenna apparatus.
Figure 7:
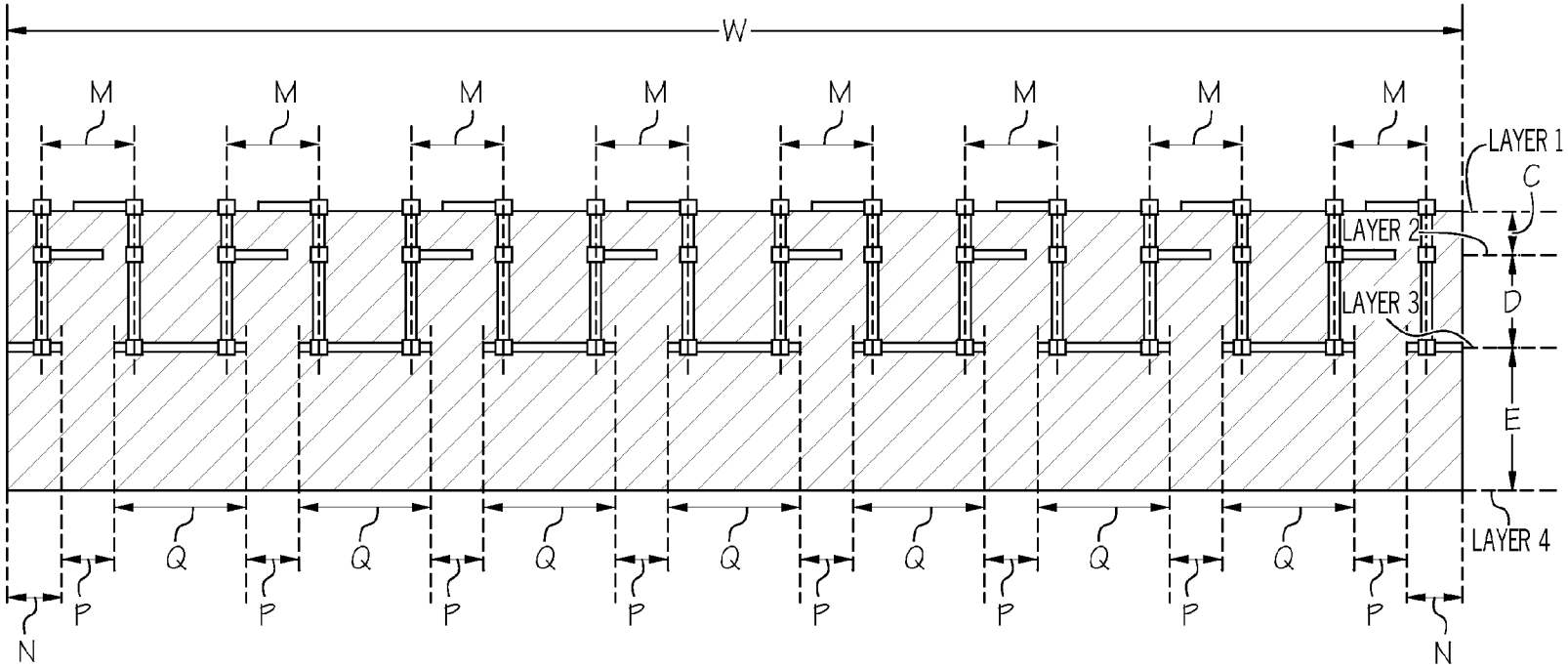
FIG. 7 is a cross-sectional view, taken approximately along line 7-7 shown in FIG. 4, of the surface card antenna apparatus.
Figure 8:
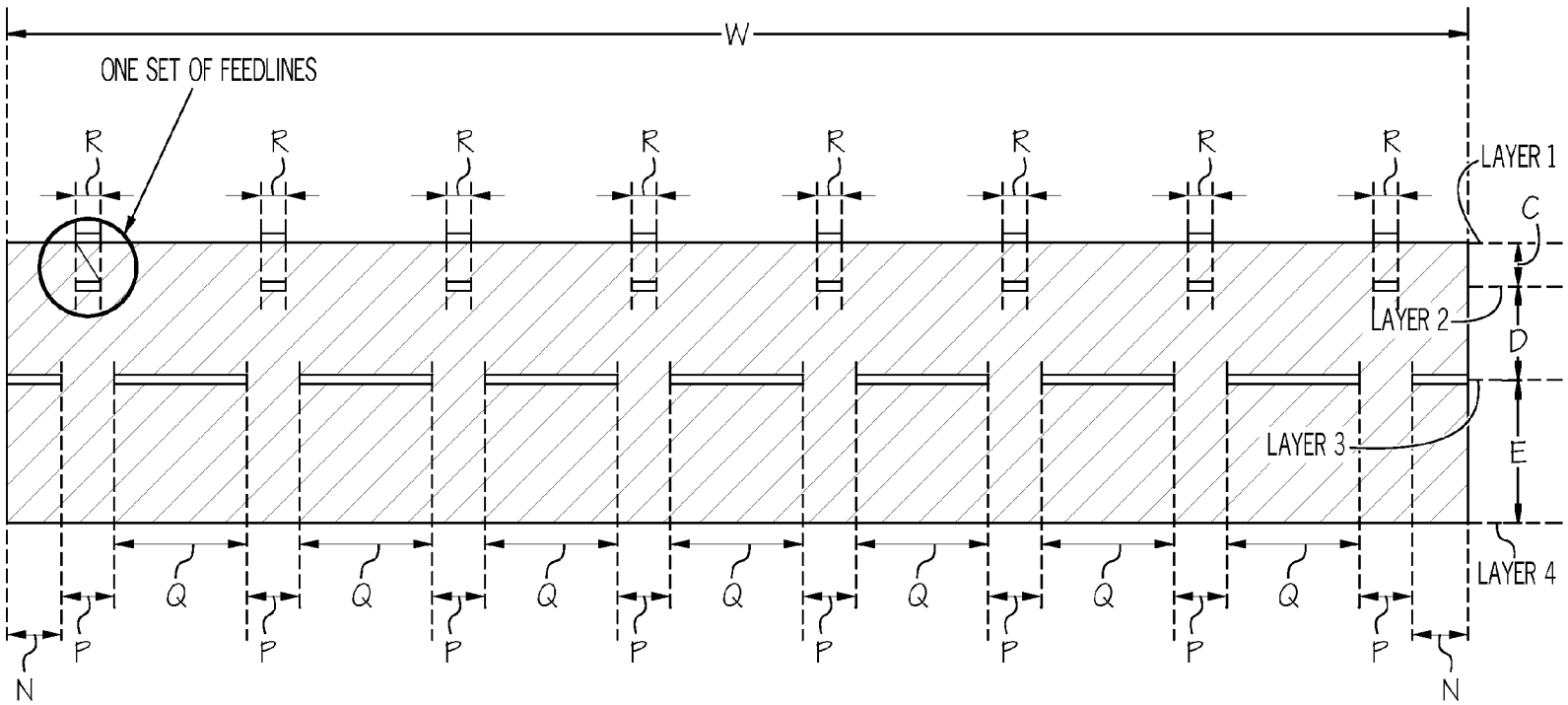
FIG. 8 is a cross-sectional view, taken approximately along line 8-8 shown in FIG. 4, of the surface card antenna apparatus.
Figure 9:
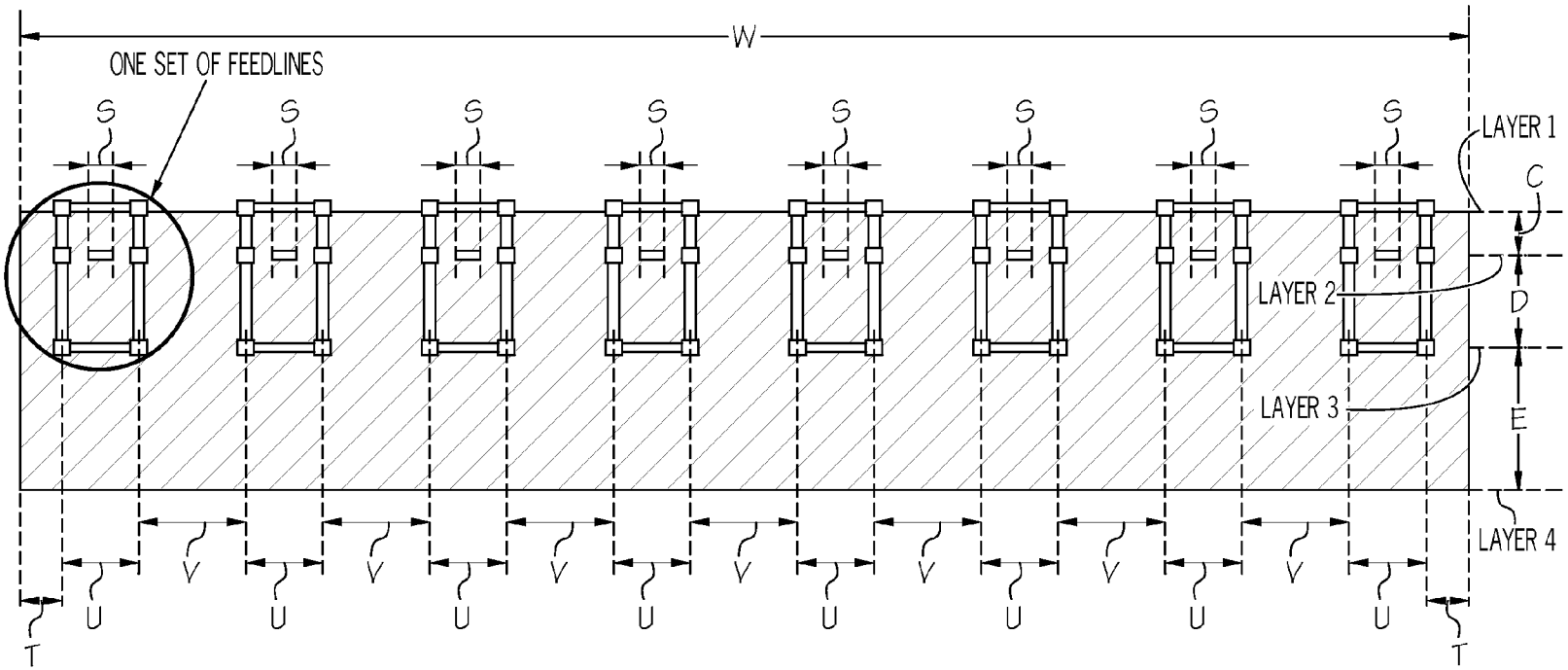
FIG. 9 is a cross-sectional view, taken approximately along line 9-9 shown in FIG. 4, of the surface card antenna apparatus.
Figure 10:
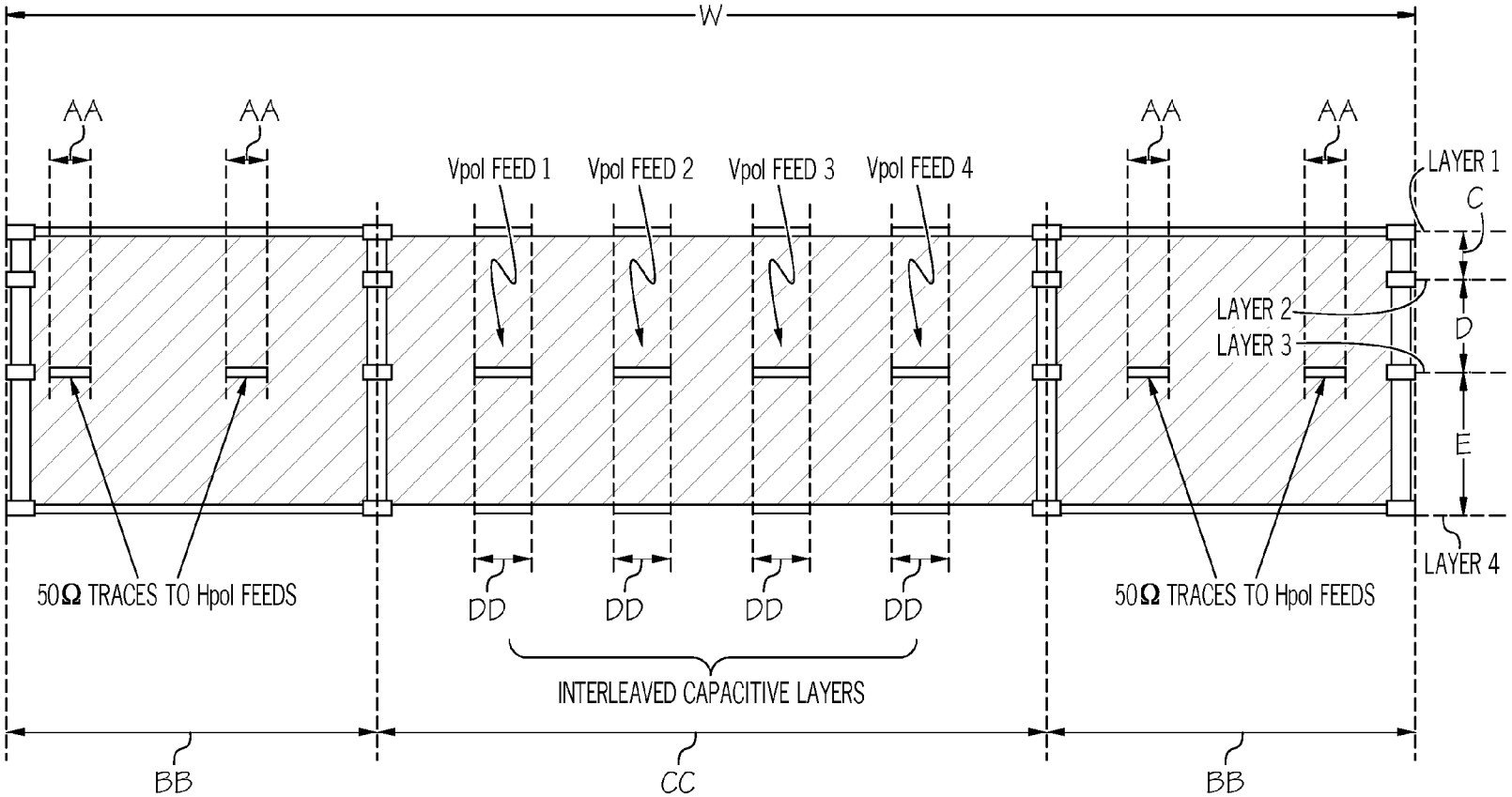
FIG. 10 is a cross-sectional view, taken approximately along line 10-10 shown in FIG. 4, of the surface card antenna apparatus.
Figure 11:
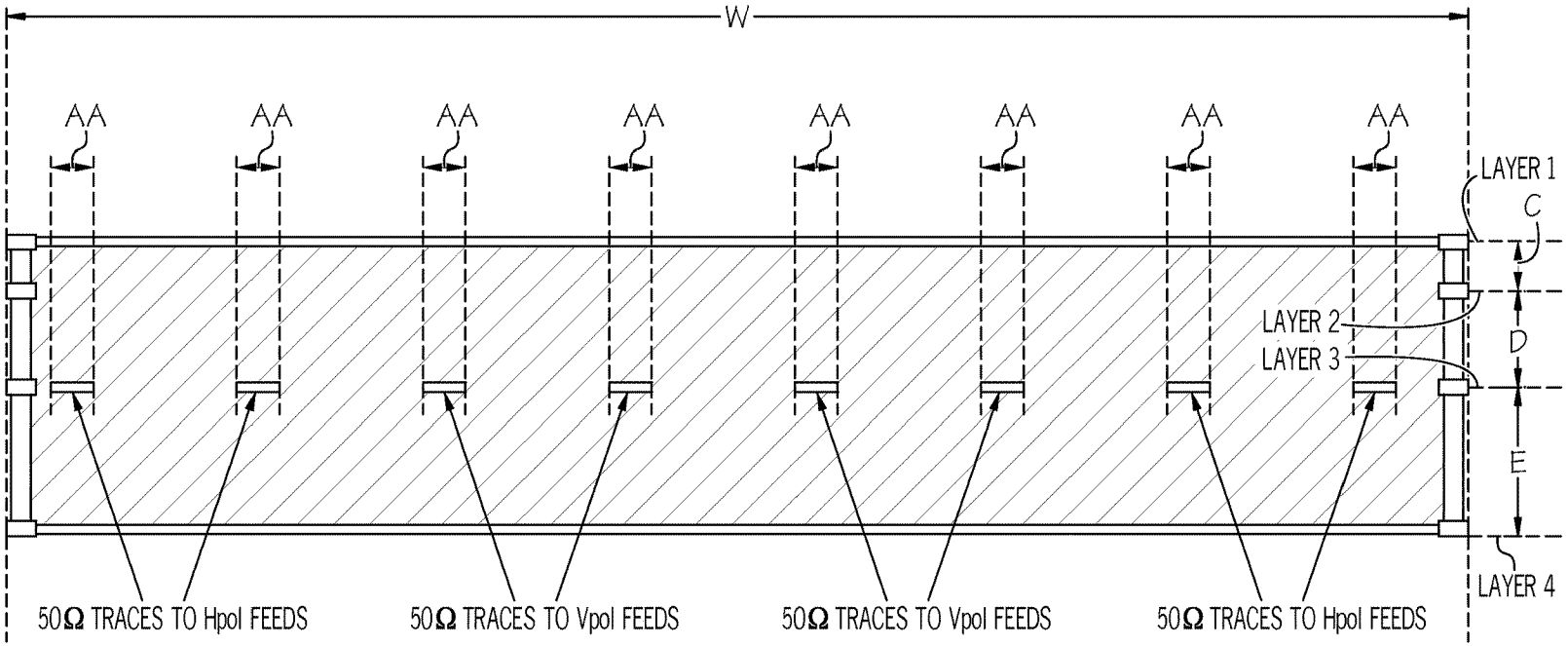
FIG. 11 is a cross-sectional view, taken approximately along line 11-11 shown in FIG. 4, of the surface card antenna apparatus.
Figure 12:
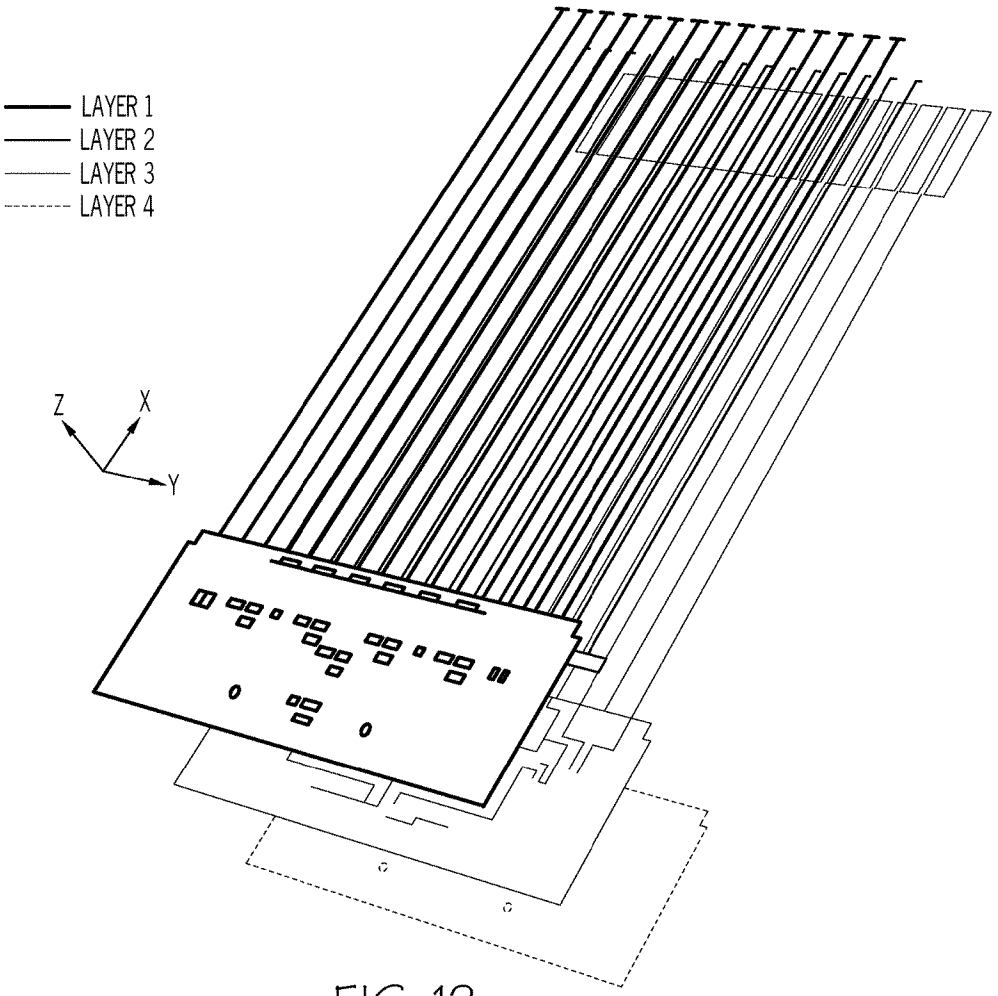
FIG. 12 is an exploded view of different layers of the surface card antenna apparatus of FIG. 3.

Referring to FIG. 4, a top view, looking approximately in the direction of arrow "4" shown in FIG. 3, of surface card antenna apparatus 300 is shown. Each of FIGS. 5-11 is a cross-sectional view, taken approximately along corresponding numbered section lines shown in FIG. 4, of surface card antenna apparatus 300. FIG. 12 is an exploded view of different layers of surface card antenna apparatus 300 shown in FIG. 3. As shown in FIG. 12, surface card antenna apparatus 300 comprises four layers Layer 1, Layer 2, Layer 3, Layer 4. As shown in FIGS. 5-12, various descriptions are provided. In addition, as shown in FIGS. 3 and 5-12, various dimensions (designated by reference letters A, B, C, D, E, F, G, H, I, J, K, L, M, N, P, Q, R, S, T, U, V, W, AA, BB, CC, DD) are shown.

For the example embodiment shown in FIG. 3, the various dimensions may comprise values as shown in Table 1.

TABLE 1

| Dimension | Inches |
|---|---|
| A | 2.25 |
| B | 10 |
| C | 0.006 |
| D | 0.012 |
| E | 0.018 |
| F | 1.5 |
| G | 0.075 |
| H | 0.13 |
| I | 6.045 |
| J | 3 |
| K | 0.75 |
| L | 12.25 |
| M | 0.175 |
| N | 0.3375 |
| P | 0.075 |
| Q | 0.675 |
| R | 0.015 |
| S | 0.007 |
| T | 0.355 |
| U | 0.04 |
| V | 0.71 |
| W | 6 |
| AA | 0.018 |
| BB | 1.375 |
| CC | 3.25 |
| DD | 0.27 |

The dimension values shown in Table 1 are only example dimension values. Other dimension values are possible in other embodiments.

Single circuit board 310 has major side surface 312 (FIG. 4). Surface card antenna apparatus 300 also includes horizontal polarization antenna portion 320 mounted on major side surface 312 of single circuit board 310. Surface card antenna apparatus 300 also includes vertical polarization antenna portion 330 mounted on major side surface 312 of single circuit board 310. Single circuit board 310 may comprise polyimide material.

Horizontal polarization antenna portion 320 is mounted at first end portion 314 of single circuit board 310. Vertical polarization antenna portion 330 is mounted at second end portion 316 of single circuit board 310. A plurality of feedlines 340 interconnects horizontal polarization antenna portion 320 and vertical polarization antenna portion 330. Vertical polarization antenna portion 330 includes metal ground plane 333.

Vertical polarization antenna portion 330 includes surface-mountable vertical polarization splitters/combiners 332*a*, 332*b*, 332*c* (FIG. 3) mounted in vicinity of vertical polarization antenna portion 330. Horizontal polarization antenna portion 320 includes surface-mountable horizontal polarization splitters/combiners 322*a*, 322*b*, 322*c* mounted in vicinity of vertical polarization antenna portion 330. Surface mount power splitters/combiners may comprise Model ADP-2-20 commercially available from Mini-Circuits located in Brooklyn, N.Y.

Vertical polarization antenna portion 330 further includes vertical radio frequency (RF) connector 331 mounted in vicinity of vertical polarization antenna portion 330. Horizontal polarization antenna portion 320 further includes horizontal RF connector 321 mounted in vicinity of vertical polarization antenna portion 330. RF connectors may comprise Model PCB.SMAFSTJ.A.HT commercially available from Taoglas Antenna Solutions located in Enniscorthy, Co. Wexford, Ireland.

Figure 13:
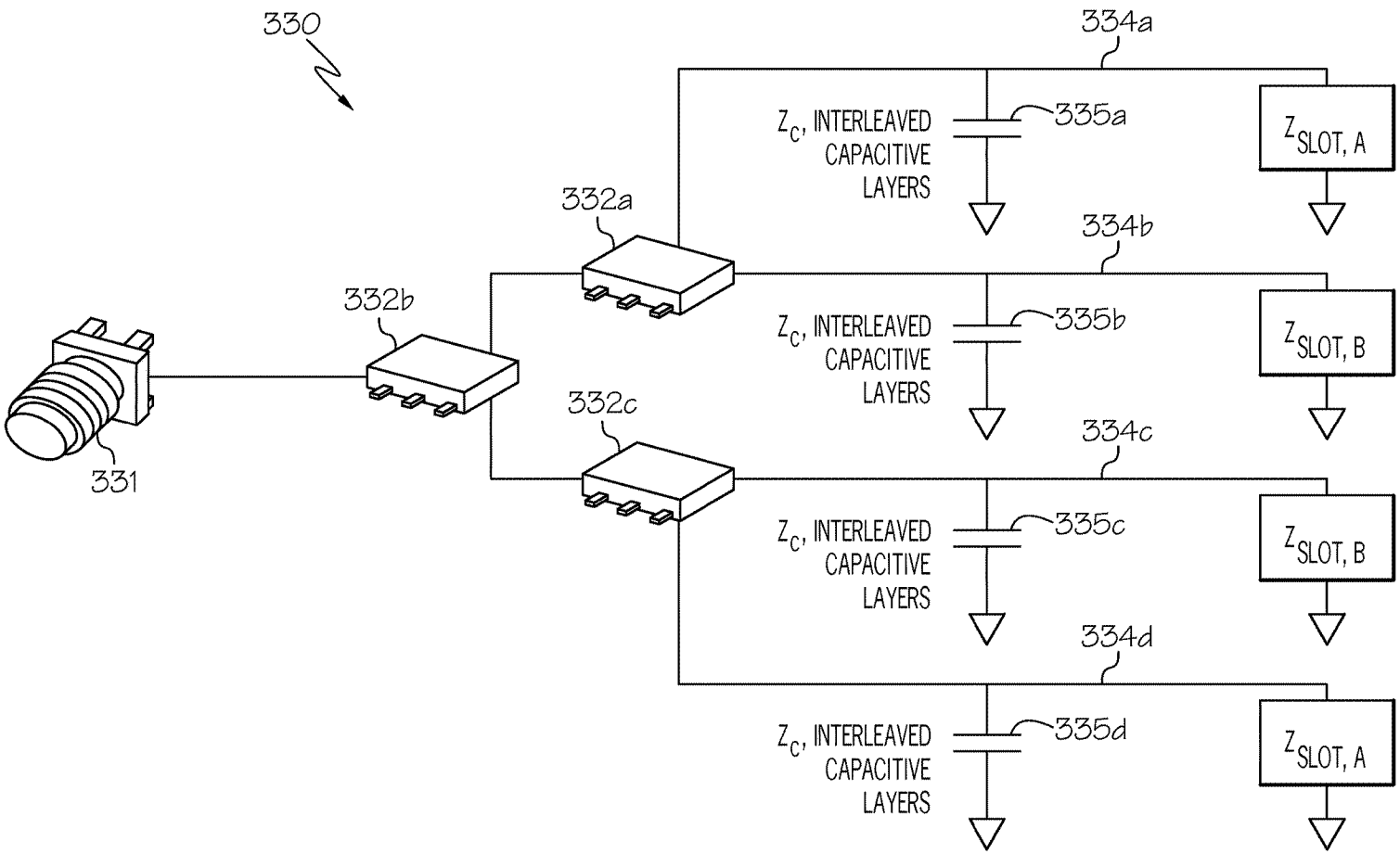
FIG. 13 is a schematic diagram of a vertical polarization antenna portion of the surface card antenna apparatus of FIG. 3.

FIG. 13 is a schematic diagram of vertical polarization antenna portion 330 of surface card antenna apparatus 300 of FIG. 3. As best shown in the schematic diagram of FIG. 13, vertical polarization antenna portion 330 includes four electrical circuits 334*a*, 334*b*, 334*c*, 334*d* having associated capacitances 335*a*, 335*b*, 335*c*, 335*d*, respectively. Since feedlines for vertical polarization antenna portion 330 are symmetric within the slot, each of electrical circuits 334*a*, 334*d* has substantially a first slot impedance (e.g., $Z_{slot,\ A}$). Also, each of electrical circuits 334*b*, 334*c* has substantially a second slot impedance (e.g., $Z_{slot,B}$) which is different from the first slot impedance. In order to achieve a broad field of view for vertical polarization antenna portion 330, the radiating slot utilizes mismatched dielectric regions above and below which disrupt the complementary nature of the electromagnetic fields near the board horizon. This adds coverage to the antenna radiation pattern which would normally be a null.

Figure 14:
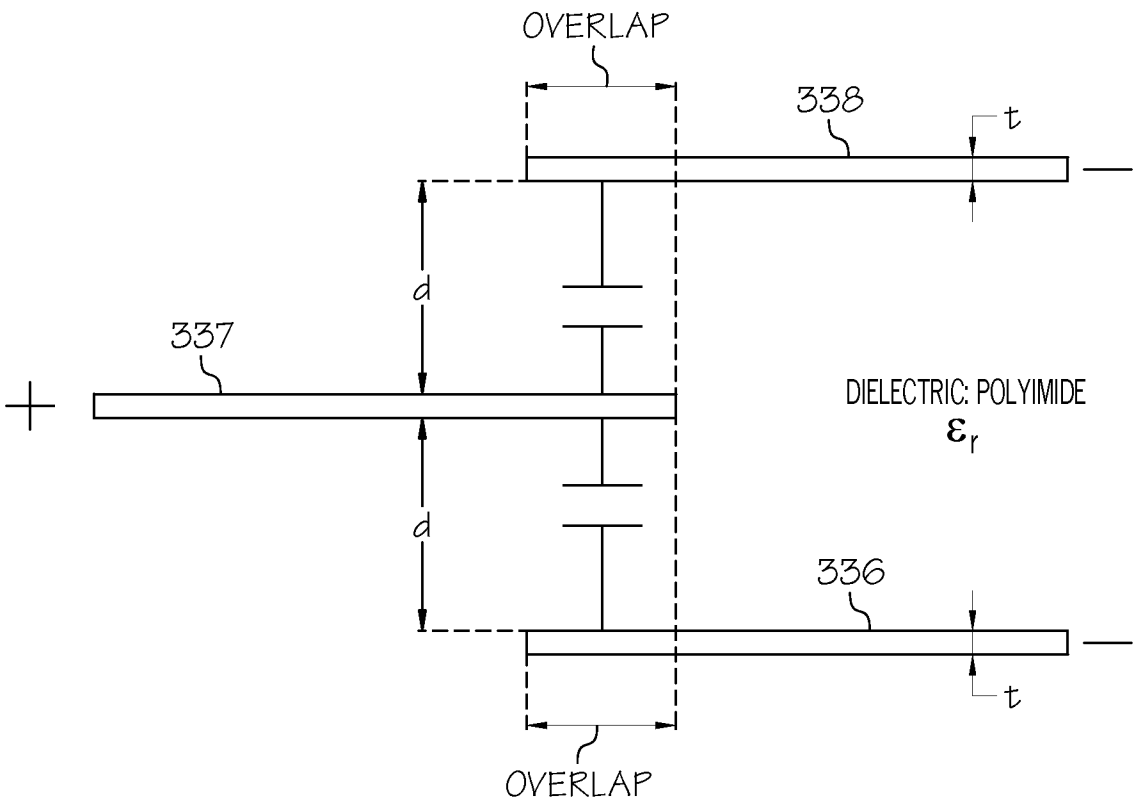
FIG. 14 is a schematic diagram of interleaved capacitive layers contained in the vertical polarization antenna portion of the schematic diagram of FIG. 13.

Each of four capacitances 335*a*, 335*b*, 335*c*, 335*d* includes a number of interleaved capacitive layers for tuning gain and tuning cutoff frequency of vertical polarization antenna portion 330. More specifically, as best shown in FIG. 14, interleaved capacitive layers include intermediate capacitive layer 337 disposed between two outer capacitive layers 336, 338. The impedance of each of four capacitances 335*a*, 335*b*, 335*c*, 335*d* is represented as follows:

$$Z_c=-j/2\pi f(C_{approx}+C_{fringe})$$

where f=frequency $$C_{approx}=(2\varepsilon_0\varepsilon_r)(\text{Area})/d$$

where $\varepsilon_0$ is dielectric of air $\varepsilon_r$ is dielectric of circuit board ($\varepsilon_r$=3.5 for polyimide)

Area is area of overlap between layers d is distance between layers $C_{fringe}$=fringe capacitance, best found through simulation Intermediate capacitive layer 337 is equidistant from each of outer capacitive layers 336, 338. As shown in example embodiment of FIG. 14, the distance "d" between corresponding surfaces of intermediate capacitive layer 337 and each of outer capacitive layers 336, 338 is about 0.018 inches. Intermediate capacitive layer 337 overlaps each of outer capacitive layers 336, 338 by the same amount of overlap. As shown in example embodiment of FIG. 14, the amount of overlap "OVERLAP" between intermediate capacitive layer 337 and each of outer capacitive layers 336, 338 is about 0.025 inches. Each of interleaved capacitive layers 336, 337, 338 has the same thickness. As shown in example embodiment of FIG. 14, the thickness "t" of each of interleaved capacitive layers 336, 337, 338 is about 0.0014 inches (1 oz/ft$^2$ copper).

Figure 15:
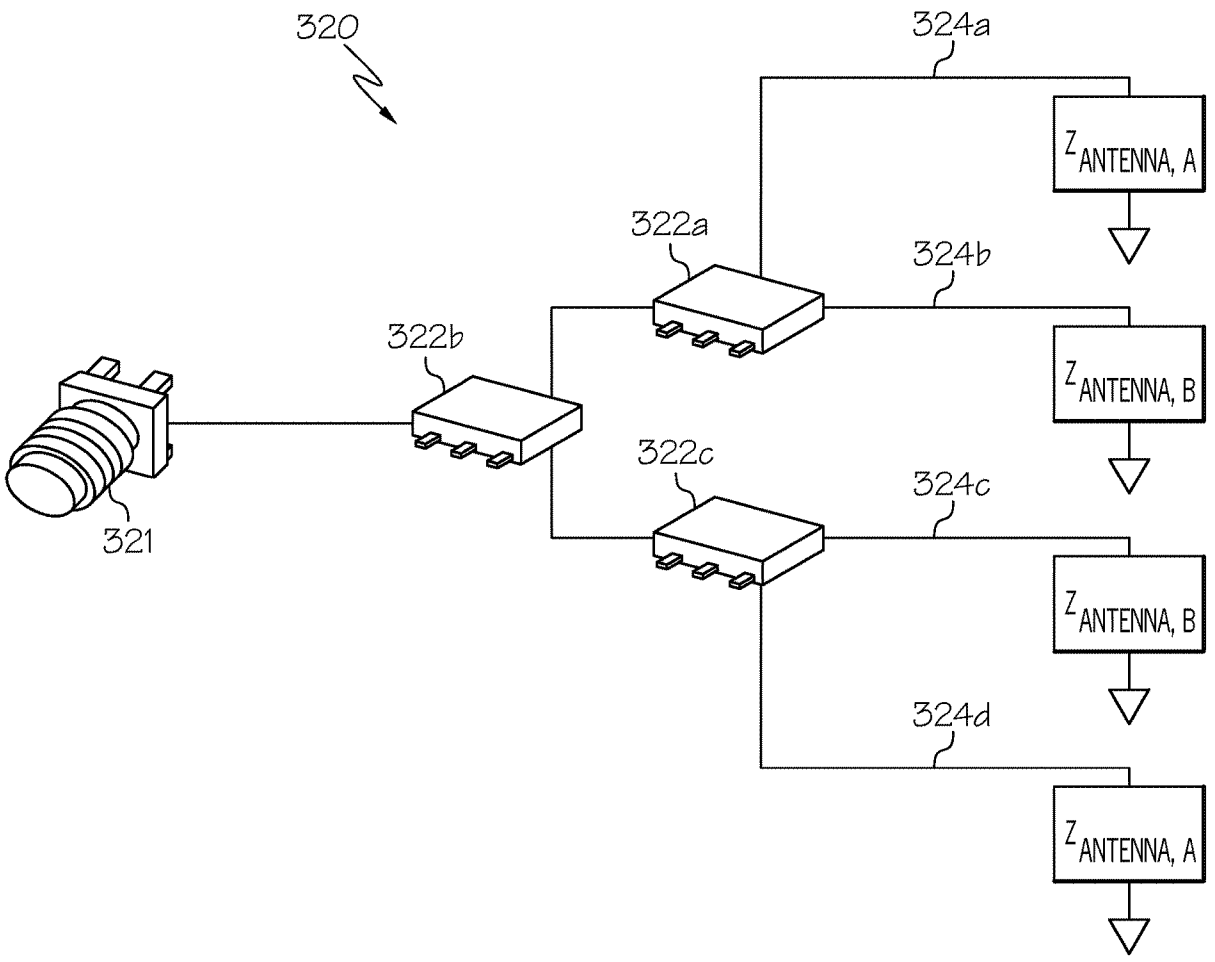
FIG. 15 is a schematic diagram of a horizontal polarization antenna portion of the surface card antenna apparatus of FIG. 3.

FIG. 15 is a schematic diagram of horizontal polarization antenna portion 320 of surface card antenna apparatus 300 of FIG. 3. As best shown in the schematic diagram of FIG. 15, horizontal polarization antenna portion 320 includes four electrical circuits 324*a*, 324*b*, 324*c*, 324*d*. Since feedlines for horizontal polarization antenna portion 320 are symmetric within the array, each of electrical circuits 324*a*, 324*d* has substantially a first antenna impedance (e.g., $Z_{antenna,\ A}$). Also, each of electrical circuits 324*b*, 324*c* has substantially a second antenna impedance (e.g., $Z_{antenna,\ B}$) which is different from the first antenna impedance.

It should be apparent that the above-described surface card antenna apparatus 300 implements an integrated dual polarization antenna on a single circuit board. The integrated dual polarization antenna is mountable on an aircraft in accordance with applicable industry regulations, such as FAA regulations for example.

It should also be apparent that the integrated dual polarization antenna has the capability to communicate over a large portion of the electromagnetic spectrum for both vertical and horizontal polarizations. This allows the aircraft to communicate over portions of the spectrum using fewer individual antennae. The number of individual antenna installations should be reduced by 50% due to the dual polarization capability, and potentially by a total of 75% or more due to the broad frequency coverage that replaces multiple antennae covering only a portion of the frequency spectrum.

Although the above-description describes a surface card antenna apparatus for airplanes in the aviation industry in accordance with FAA regulations, it is contemplated that the surface card antenna apparatus may be implemented for any industry in accordance with the applicable industry standards.

Although various embodiments of the disclosed surface card antenna apparatus have been shown and described, modifications may occur to those skilled in the art upon reading the specification. The present application includes such modifications and is limited only by the scope of the claims.

What is claimed is:

1. A surface card antenna apparatus (300), comprising:

a single circuit board (310) having a major side surface (312);

a horizontal polarization antenna portion (320) mounted on the major side surface of the single circuit board;

a vertical polarization antenna portion (330) mounted on the major side surface of the single circuit board, wherein the vertical polarization antenna portion includes a vertically polarized slot antenna; and a plurality of feedlines (340) directly interconnecting the horizontal polarization antenna portion to the vertical polarization antenna portion, wherein the plurality of feedlines comprise a first feedline and a second feedline, wherein a first end of the first feedline is directly connected to the horizontal polarization antenna portion and a second end of the first feedline is directly connected to the vertical polarization antenna portion, and wherein a first end of the second feedline is directly connected to the horizontal polarization antenna portion and a second end of the second feedline is directly connected to the vertical polarization antenna portion.

2. The surface card antenna apparatus according to claim 1, wherein the horizontal polarization antenna portion is mounted at one end portion (314) of the single circuit board, and the vertical polarization antenna portion is mounted at an opposite end portion (316) of the single circuit board.

3. The surface card antenna apparatus according to claim 1, wherein the vertical polarization antenna portion includes a number of vertical polarization splitters/combiners (332*a*, 332*b*, 332*c*) mounted in vicinity of the vertical polarization antenna portion, and the horizontal polarization antenna portion includes a number of horizontal polarization splitters/combiners (322*a*, 322*b*, 322*c*) mounted in vicinity of the vertical polarization antenna portion.

4. The surface card antenna apparatus according to claim 1, wherein the vertical polarization antenna portion includes a vertical radio frequency "RF" connector (331) mounted in vicinity of the vertical polarization antenna portion, and the horizontal polarization antenna portion includes a horizontal RF connector (321) mounted in vicinity of the vertical polarization antenna portion.

5. The surface card antenna apparatus according to claim 1, wherein the single circuit board comprises a polyimide material.

6. The surface card antenna apparatus according to claim 1, wherein the vertical polarization antenna portion includes four electrical circuits (334*a*, 334*b*, 334*c*, 334*d*) each electrical circuit having an associated capacitance (335*a*, 335*b*, 335*c*, 335*d*).

7. The surface card antenna apparatus according to claim 6, wherein two (334*a*, 334*d*) of the four electrical circuits have substantially a first slot impedance "$Z_{slot,\ A}$", and the other two (334*b*, 334*c*) of the four electrical circuits have substantially a second slot impedance "$Z_{slot,\ B}$" which is different from the first slot impedance.

8. The surface card antenna apparatus according to claim 7, wherein each of the four electrical circuits includes a number of interleaved capacitive layers (336, 337, 338) for tuning gain and tuning cutoff frequency of the vertical polarization antenna portion.

9. The surface card antenna apparatus according to claim 8, wherein each of the interleaved capacitive layers includes an intermediate capacitive layer (337) disposed between two outer capacitive layers (336, 338).

10. The surface card antenna apparatus according to claim 9, wherein i. the intermediate capacitive layer is equidistant from each of the two outer capacitive layers, and ii. the intermediate capacitive layer overlaps each of the two outer capacitive layers by the same amount of overlap.

11. The surface card antenna apparatus according to claim 1, wherein the vertical polarization antenna portion includes a metal ground plane (333).

12. The surface card antenna apparatus according to claim 1, wherein the horizontal polarization antenna portion is mounted at one edge of the single circuit board.

13. The surface card antenna apparatus according to claim 1, wherein the first end of the first feedline is directly connected to a first portion of the horizontal polarization antenna portion and the second end of the first feedline is directly connected to a first portion of the horizontal polarization antenna portion, and wherein the first end of the second feedline is directly connected to a second portion of the horizontal polarization antenna portion and the second end of the second feedline is directly connected to a second portion of the horizontal polarization antenna portion.

14. The surface card antenna apparatus according to claim 1, wherein the plurality of feedlines further comprise a third feedline, wherein a first end of the third feedline is directly connected to the horizontal polarization antenna portion and a second end of the third feedline is directly connected to the vertical polarization antenna portion.

15. The surface card antenna apparatus according to claim 14, wherein the first end of the third feedline is directly connected to a third portion of the horizontal polarization antenna portion and the second end of the third feedline is directly connected to a third portion of the horizontal polarization antenna portion.

16. A surface card antenna apparatus (300), comprising:

a single circuit board (310);

a horizontal polarization antenna portion (320) mounted on the single circuit board;

a vertical polarization antenna portion (330) mounted on the single circuit board, wherein the vertical polarization antenna portion includes a vertically polarized slot antenna, wherein the vertical polarization antenna portion includes a number of interleaved capacitive layers (336, 337, 338) for tuning gain and tuning cutoff frequency of the vertical polarization antenna portion; and a plurality of feedlines (340) directly interconnecting the horizontal polarization antenna portion to the vertical polarization antenna portion, wherein the plurality of feedlines comprise a first feedline and a second feedline, wherein a first end of the first feedline is directly connected to the horizontal polarization antenna portion and a second end of the first feedline is directly connected to the vertical polarization antenna portion, and wherein a first end of the second feedline is directly connected to the horizontal polarization antenna portion and a second end of the second feedline is directly connected to the vertical polarization antenna portion.

17. The surface card antenna apparatus according to claim 16, wherein each of the number of interleaved capacitive layers includes an intermediate capacitive layer (337) disposed between two outer capacitive layers (336, 338).

18. The surface card antenna apparatus according to claim 17, wherein i. the intermediate capacitive layer is equidistant from each of the two outer capacitive layers, and ii. the intermediate capacitive layer overlaps each of the two outer capacitive layers by the same amount of overlap.

19. The surface card antenna apparatus according to claim 18, wherein each of the interleaved capacitive layers has the same thickness.

20. The surface card antenna apparatus according to claim 19, wherein i. the thickness of each of the interleaved capacitive layers is about 0.0014 inches, ii. the amount of overlap between the intermediate capacitive layer and each of the outer capacitive layers is about 0.025 inches, and iii. the distance between corresponding surfaces of the intermediate capacitive layer and the two outer capacitive layers is about 0.018 inches.

21. A surface card antenna apparatus (300), comprising:

a single circuit board (310) having a major side surface (312), wherein the single circuit board comprises a polyimide material;

a vertical polarization antenna portion (330) mounted on the major side surface of the single circuit board, wherein i. the vertical polarization antenna portion is mounted at one end portion (316) of the single circuit board, ii. the vertical polarization antenna portion includes a number of vertical polarization splitters/combiners (332*a*, 332*b*, 332*c*) mounted in vicinity of the vertical polarization antenna portion, and iii. the vertical polarization antenna portion includes a vertical radio frequency "RF" connector (331) mounted in vicinity of the vertical polarization antenna portion;

iv. the vertical polarization antenna portion includes a vertically polarized slot antenna;

a horizontal polarization antenna portion (320) mounted on the major side surface of the single circuit board, wherein i. the horizontal polarization antenna portion is mounted at an opposite end portion (314) of the single circuit board, ii. the horizontal polarization antenna portion includes a number of horizontal polarization splitters/combiners (322*a*, 322*b*, 322*c*) mounted in vicinity of the vertical polarization antenna portion, and iii. the horizontal polarization antenna portion includes a horizontal RF connector (321) mounted in vicinity of the vertical polarization antenna portion; and a plurality of feedlines (340) directly interconnecting the horizontal polarization antenna portion to the vertical polarization antenna portion, wherein the plurality of feedlines comprise a first feedline and a second feedline, wherein a first end of the first feedline is directly connected to the horizontal polarization antenna portion and a second end of the first feedline is directly connected to the vertical polarization antenna portion, and wherein a first end of the second feedline is directly connected to the horizontal polarization antenna portion and a second end of the second feedline is directly connected to the vertical polarization antenna portion.

22. The surface card antenna apparatus according to claim 21, wherein i. the vertical polarization antenna portion includes four electrical circuits (334*a*, 334*b*, 334*c*, 334*d*) each electrical circuit having an associated capacitance (335*a*, 335*b*, 335*c*, 335*d*), ii. two (334*a*, 334*d*) of the four electrical circuits have substantially a first slot impedance "$Z_{slot,\ A}$", and iii. the other two (334*b*, 334*c*) of the four electrical circuits have substantially a second slot impedance "$Z_{slot,\ B}$" which is different from the first slot impedance.

23. The surface card antenna apparatus according to claim 22, wherein i. each of the four electrical circuits includes a number of interleaved capacitive layers (336, 337, 338) for tuning gain and tuning cutoff frequency of the vertical polarization antenna portion, ii. each of the interleaved capacitive layers includes an intermediate capacitive layer (337) disposed between two outer capacitive layers (336, 338), iii. the intermediate capacitive layer is equidistant from each of the two outer capacitive layers, and iv. the intermediate capacitive layer overlaps each of the two outer capacitive layers by the same amount of overlap.

* * * * *